US010377596B2

(12) United States Patent
Tunioli et al.

(10) Patent No.: US 10,377,596 B2
(45) Date of Patent: Aug. 13, 2019

(54) ROLL FEEDER DEVICE

(71) Applicant: RI-FLEX ABRASIVES S.R.L., Spilamberto (Modena) (IT)

(72) Inventors: Roberto Tunioli, Bologna (IT); Sergio Taddia, Savigno (IT)

(73) Assignee: RI-FLEX ABRASIVES S.R.L., Spilamberto (IT)

( * ) Notice: Subject to any disclaimer, the term of this patent is extended or adjusted under 35 U.S.C. 154(b) by 0 days.

(21) Appl. No.: 15/957,169

(22) Filed: Apr. 19, 2018

(65) Prior Publication Data

US 2018/0312357 A1 Nov. 1, 2018

(30) Foreign Application Priority Data

Apr. 27, 2017 (IT) ..... 102017000045784

(51) Int. Cl.
*B65H 19/12* (2006.01)
*B65H 16/04* (2006.01)

(52) U.S. Cl.
CPC ..... *B65H 19/123* (2013.01); *B65H 16/04* (2013.01); *B65H 19/12* (2013.01); *B65H 2301/41368* (2013.01)

(58) Field of Classification Search
CPC ..... B65H 19/126; B65H 19/12; B65H 16/04; B65H 19/2284; B65H 19/30; B65H 19/2292; B65H 2301/41368; B65H 2301/41361; B65H 16/021; B65H 16/023; B65H 16/103; B65H 18/02; B65H 18/021; B65H 18/026
USPC ..... 242/560, 555.2, 559.3, 560.1
See application file for complete search history.

(56) References Cited

U.S. PATENT DOCUMENTS 3,332,636 A * 7/1967 Rockstrom ..... B65H 19/2284 242/530.4
3,718,302 A * 2/1973 Mount ..... B65H 18/106 242/533.3
4,770,366 A * 9/1988 Hood ..... B21C 47/16 242/128
4,896,842 A * 1/1990 Heinz ..... B65B 41/12 242/559.1
5,031,381 A 7/1991 Focke
5,219,127 A * 6/1993 Boldrini ..... B65H 19/123 242/559.1
5,601,252 A * 2/1997 Draghetti ..... B65H 19/123 242/559.1
9,428,363 B2 * 8/2016 Seifert ..... B65H 54/20
2003/0032538 A1 2/2003 Spatafora et al.
2006/0051185 A1 * 3/2006 Spatafora ..... B65H 16/04 414/222.01

(Continued)

FOREIGN PATENT DOCUMENTS

DE 102013204956 A1 9/2014

*Primary Examiner* — Michael R Mansen
*Assistant Examiner* — Raveen J Dias
(74) *Attorney, Agent, or Firm* — Pearne & Gordon LLP

(57) ABSTRACT

A roll feeding device, including: a support shaft (10), equipped with a longitudinal axis (Y) and provided to support one or more rolls (C), which includes a first end (11) and a second end (12); one or more pusher arms (20), movable along a direction parallel to the longitudinal axis (Y) in both directions, each of which is movable between an active position, in which it is arranged alongside a roll (C) and can come into contact with it during a movement parallel to the longitudinal axis (Y), and an inactive position.

8 Claims, 3 Drawing Sheets

(56) References Cited

U.S. PATENT DOCUMENTS

| | | | | |
|---|---|---|---|---|
| 2016/0023370 | A1 | 1/2016 | Muller | |
| 2017/0260018 | A1* | 9/2017 | Hack | B65H 19/30 |

* cited by examiner

ROLL FEEDER DEVICE

The present invention relates to a roll feeder device, particularly useful for a machine for producing abrasive discs.

Abrasive discs means those tools, widely used in industry, that comprise a disc support, that can be associated with a rotary tool, to which a plurality of sheets of abrasive material are applied, typically sheets of abrasive fabric.

Machines are currently available on the market for the automated production of abrasive discs. Such machines substantially cut out the sheets of abrasive fabric and apply the sheets to the disc support, previously fed to the machine.

The sheets of abrasive fabric are cut out by a continuous web of abrasive fabric that is loaded on board the machine in the form of a roll. The leading end of the roll is manually associated with a cutting assembly which, once started, autonomously unwinds the web gradually and cuts it into the desired sheets.

In the machines currently available, the replacement of the empty roll is performed manually. In substance, once the roll is empty an operator inserts a new roll into the machine and feeds the leading end of the roll to the cutting assembly. This causes the machine to stop for a relatively extended period of time, as well as requiring the supervision of an operator who, although not necessarily having to constantly oversee the operation of the machine, needs to be available to intervene for replacing the empty roll.

The applicant has designed an automatic web feeder able to automatically feed the leading end of a new roll to the cutting device. The automatic feeder comprises an orientation unit, equipped with a gripping plane on which the leading ends of a certain number of rolls can be retained. The various rolls are placed on a support shaft. A gripping element, equipped with a gripper, is provided to reach the free end of a first roll of web. In particular, the gripper is movable between a first position, in which it grabs the end of the first roll, and a second position, in which it offers the free end of the roll to the cutting device or assembly. The gripper is movable on a rotation plane by means of the rotation of a support arm so as to draw the web in advancement and offer the free end to the cutting assembly which, in a known way, grasps the free end and starts to gradually draw the web in advancement for subsequent processing.

Once the first roll is empty, the orientation unit must translate laterally so as to bring the free end of a new web onto the rotation plane of the support arm of the gripper, so that the latter can grasp the free end of the new roll. To prevent the web suffering excessive twisting, the rolls must also slide on the support shaft at the same time as the orientation unit. The rolls are currently replaced directly by the operator.

The object of the present invention is to offer a roll feeder device that relieves the operator also of the remaining roll pushing intervention, so as to make the machine totally automatic.

Characteristics and advantages of the present invention will more fully emerge from the following detailed description of an embodiment of the invention, as illustrated in a non-limiting example in the accompanying drawings, in which.

The roll feeder device according to present invention comprises a support shaft (10), provided with a longitudinal axis (Y). As shown in the figures, the support shaft (10) is provided to support one or more rolls (C). The rolls (C) are inserted on the support shaft (10) at a central opening, so as to be located concentric to the longitudinal axis (Y) and parallel to each other.

Figure 1:
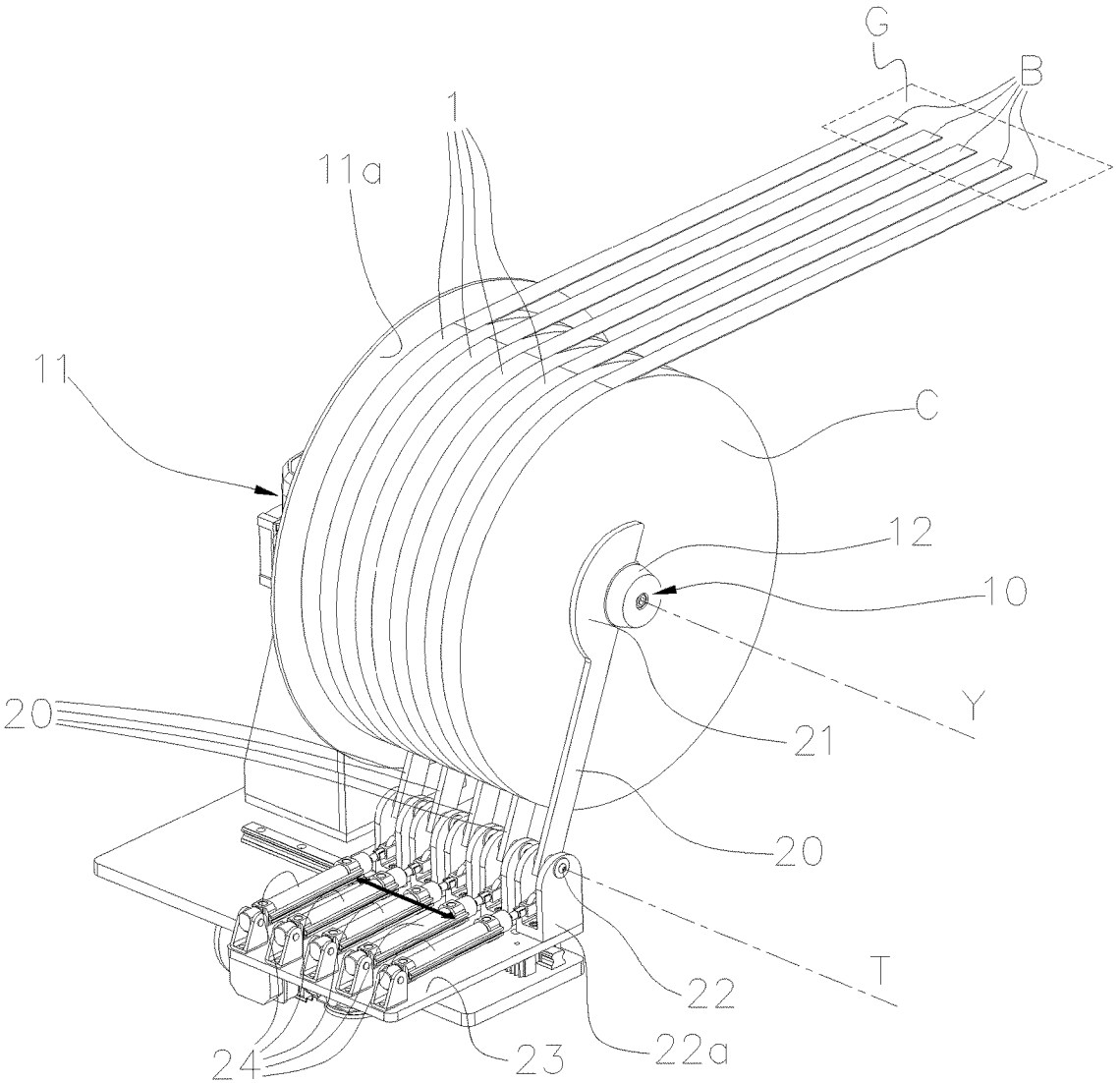
FIG. 1 shows an isometric view of the feeder device according to the present invention, in an initial operating configuration.

FIG. 1 further schematically indicates the approximate position of an orientation unit (G) with which the leading ends (B) of the various rolls can be associated.

The support shaft (10) comprises a first end (11) and a second end (12). In proximity to the first end (11) of the support shaft (10) a feeding position of a roll (C) is defined. In such feeding position, the roll (C) can be grabbed by an automatic feeder, not illustrated, which grasps its leading end (B) to offer it to a cutting device, not illustrated, of a machine for producing abrasive discs, of the type mentioned in the introductory part of the description. For that purpose, the first end of the support shaft (10) is provided with a striking element (11*a*), in contact with which a roll (C) can strike sliding along the support shaft (10), as will be clarified below. The support shaft (10) and the striking element (11*a*) are set in rotation about the longitudinal axis (Y), by means of an actuator (15), for example a rotary actuator (15) associated with the support shaft (10) through a belt (16), for determining the unwinding of the roll (C). Preferably, the striking element (11*a*) is integral in rotation with the support shaft (10).

The feeder device comprises one or more pusher arms (20), movable along a direction parallel to the longitudinal axis (Y) in both directions. In particular, the pusher arms (20) are movable along the support shaft (10) for a forward stroke, directed towards the first end (11) of the support shaft (10), and for an opposite return stroke.

Each of the pusher arms (20) is movable between an active position, in which it is arranged alongside a roll (C) and can come into contact with it during a movement parallel to the longitudinal axis (Y), and an inactive position. In the inactive position, each pusher arm (20) is able to surpass the first end (11) of the support shaft (10). When it is in its active position, each pusher arm (20), sliding along the support shaft (10) in the forward stroke, is able to push a roll (C) towards the first end (11) and in contact with the striking element (11*a*).

In the embodiment shown, each pusher arm (20) has a first end (21) which, in the active position, is arranged in proximity to the support shaft (10). Advantageously, the first end (21) may be C-shaped so as to partially embrace the support shaft (10). The C-shaped conformation further defines a central and relatively large contact surface with the roll (C), which allows the roll (C) to be pushed along the support shaft (10) without jamming. In the inactive position, the first end (21) of the arm (20) is instead positioned away from the support shaft (10).

Figure 2:
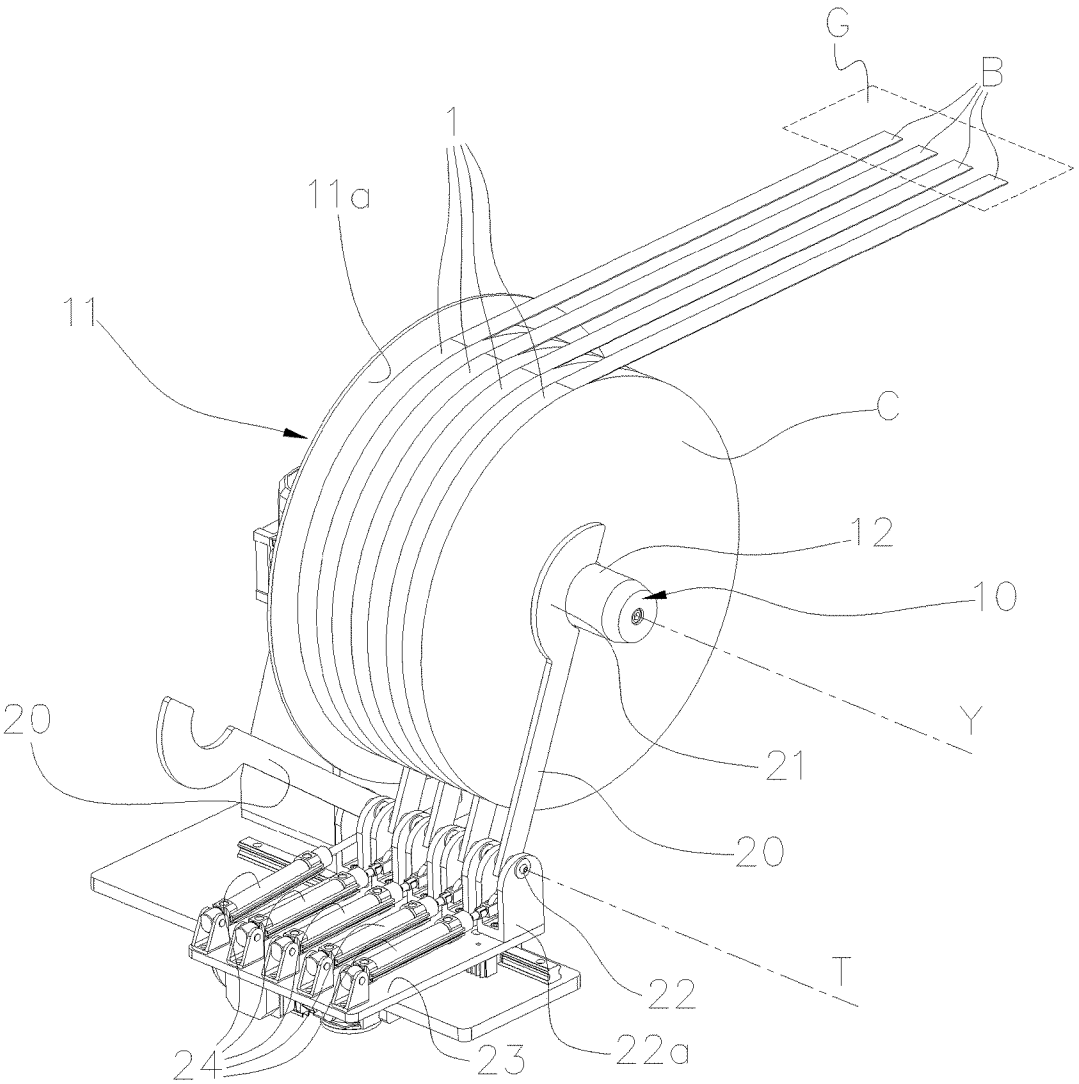
FIG. 2 shows the feeder device of FIG. 1, in a subsequent operating configuration.
Figure 3:
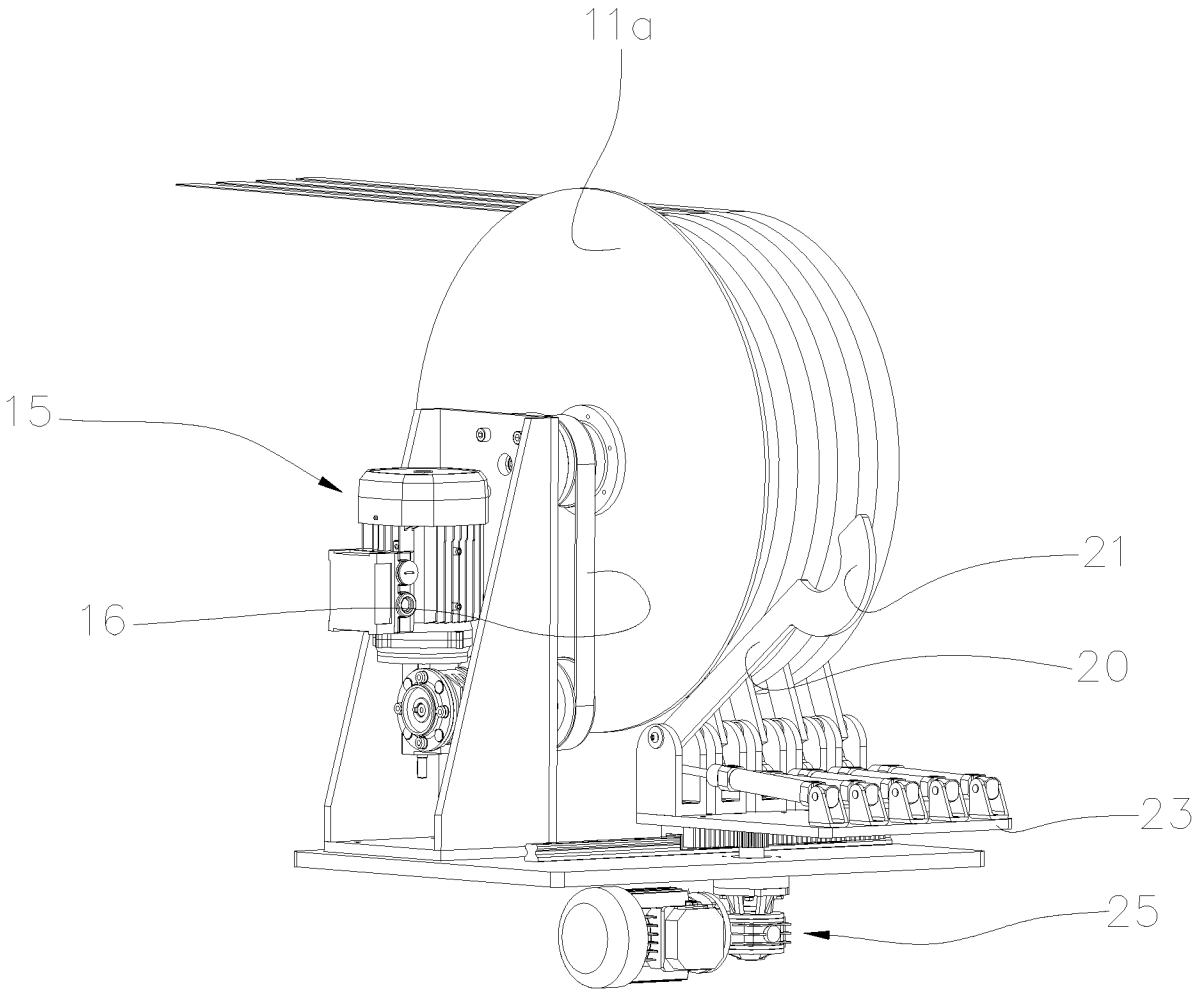
FIG. 3 shows the feeder device in the operating configuration of FIG. 2, seen from a substantially opposite point of view.

Each pusher arm (20) is movable in rotation around an axis (T) parallel to the longitudinal axis (Y) between the active and inactive positions. In the active position, visible in FIG. 1 for all the pusher arms (20), the first end (21) of each pusher arm (20) is arranged in contact or in proximity to the support shaft (10). Rotating towards the inactive position, the first end (21) moves away from the support shaft (10), as shown in FIG. 2 for the closest pusher arm (20) to the first end (11) of the support shaft (10). In the inactive position, this pusher arm (20) can pass beyond the first end (11) and the striking element (11*a*) sliding along the longitudinal axis (Y) in the forward stroke.

The pusher arms (20) are associated with a carriage (23) sliding in a direction parallel to the longitudinal axis (Y), by means of a prismatic guide. An actuator means (25) comprising, for example, a rotary actuator associated with a rack are provided to determine the sliding of the carriage (23).

In particular, each pusher arm (20) is associated with the carriage (23) by means of a rotary pin (22) parallel to the longitudinal axis (Y). Each pin (22) is associated with a U-shaped bracket (22*a*), which is solidly constrained to the carriage (23). Each pusher arm (20) is provided with an actuator (24), associated with the carriage (23), for the rotation between the active position and the inactive position. For example, the actuator (24) may be in the form of a piston which, at one end, is pivoted to the carriage (23), at the other end it is pivoted to the related pusher arm (20).

In the embodiment shown, the feeder device according to the present invention comprises a plurality of pusher arms (20), parallel to each other and arranged so as to be able to be interposed among a plurality of rolls (C). In particular, the version shown comprises five pusher arms (20), with which five rolls may be interposed (C). Each roll (C) is interposed between its own pusher arm (20) and the striking element (11*a*), i.e. each roll (C) is adjacent to its own pusher arm (20) on the side of the striking element (11*a*), so that the pusher arm (20), moving towards the striking element (11*a*), can push its own roll (C).

FIG. 1 shows an initial operating configuration of the feeder, with five rolls (C) loaded onto the support shaft (10). The leading ends (B) of each roll (C) are associated with the orientation plane (B). A roll (C) is placed in the feeding position, in contact with the striking element (11*a*). Such roll (C) is the first to be used. When the first roll (C) is empty, the related pusher arm (20), i.e. the closest arm (20) to the striking element, comes into the inactive position, rotating away from the support shaft (10). In such a configuration, the carriage (23) can slide forwards, i.e. towards the striking element (11*a*), bringing the second roll (C) into contact with the striking element (11*a*), by means of the related pusher arm (20), the second of the series (FIG. 2). The first pusher arm (20) does not obstruct the advancement stroke of the carriage (23), since it is in its inactive position in which it does not interfere with the striking element (11*a*). Once the second roll (C) is empty, the related pusher arm (20) also rotates in the inactive position, so that a third roll (C) can be brought into contact with the striking element (11*a*) by its own pusher arm (20) and by a subsequent advancement step of the carriage (23), and so on for all the rolls mounted on the support shaft (10).

Once all the rolls are empty, the carriage (23) returns to its initial position, and a new group of rolls can be mounted on the support shaft (10). The pusher arms (20) can return to the active position, each alongside its own roll (C), as shown in FIG. 1.

The feeder device has been illustrated with five pusher arms (20), but it could be provided with a different number of pusher arms (20).

For example, the feeder device could be realized with only one pusher arm (20). In that case, the rolls (C) can be loaded onto the support shaft (10) in the same position as FIG. 1, i.e. spaced from each other by a sufficient distance to allow the insertion of a pusher arm (20). In an initial configuration, the pusher arm (20) is in contact with the roll (C) which is closest to the striking element (11*a*). At the end of the first roll, and at the end of each subsequent roll, the pusher arm (20) is brought into the inactive position, it retracts by a sufficient stroke to reach the subsequent roll, it is brought into the active position and it performs an advancement stroke to bring the subsequent roll into contact with the striking element (11*a*).

The feeder device according to the present invention achieves important advantages.

Once a predefined number of rolls (C) has been loaded onto the support shaft (10), the feeder device in fact allows an empty roll to be replaced with a new one totally automatically, without the need for an operator to intervene and whose job is essentially reduced to the initial loading of the rolls (C).

The device further has a simple and reliable structure, which does not require any particular maintenance operations.

The invention claimed is:

1. A roll feeder device, characterised by the fact it comprises: a support shaft (10), equipped with a longitudinal axis (Y) and configured to support a plurality of rolls (C), the support shaft (10) including a first end (11) and a second end (12); and a plurality of pusher arms (20), each pusher arm (20) being movable along a direction parallel to the longitudinal axis (Y) in both directions, each pusher arm (20) being movable between an active position and an inactive position; when the pusher arm (20) is in the active position, it is positioned at a side of a roll (C) and may come into contact with it during a movement parallel to the longitudinal axis (Y), the plurality of pusher arms (20) being parallel to each other and being arranged so as to be interposed among the plurality of rolls (C) in the active position.

2. The feeder device according to claim 1, wherein each pusher arm (20), in the active position, has a first end (21) placed near the support shaft (10), while in the inactive position, the first end (21) is positioned away from the support shaft (10).

3. The feeder device according to claim 1, wherein each pusher arm (20) is movable in rotation around an axis parallel to the longitudinal axis (Y) when moving, between the active and inactive positions.

4. The feeder device according to claim 1, wherein each pusher arm (20) is associated with a carriage (23) slidable in a direction parallel to the longitudinal axis (Y).

5. The feeder device according to claim 4, wherein each pusher arm (20) is associated with the carriage (23) by means of a rotary pin (22) parallel to the longitudinal axis (Y) and provided with an actuator (24), associated with the carriage (23), for rotation between the active position and the inactive position.

6. The feeder device according to claim 1, wherein the first end (11) of the support shaft (10) is provided with a striking element (11*a*) for a roll (C).

7. The device according to claim 6, wherein the striking element (11*a*) for a roll includes a disk integral in rotation with the support shaft (10).

8. The device according to claim 7, wherein the support shaft (10) and the striking element (11*a*) are rotated about the longitudinal axis (Y) by means of a rotary actuator, so as to determine the unwinding of the roll (C).

* * * * *